US006109666A

United States Patent [19]

Collet

[11] Patent Number: 6,109,666

[45] Date of Patent: Aug. 29, 2000

[54] ESPAGNOLETTE OR ESPAGNOLETTE-LOCK FOR A DOOR, FRENCH WINDOW OR THE LIKE

[75] Inventor: Jean-Yves Collet, Saint-Jean-Saverne, France

[73] Assignee: Ferco International, Ferrures et Serrures de Batiment SA, Sarrebourg, France

[21] Appl. No.: 09/290,146

[22] Filed: Apr. 13, 1999

[30] Foreign Application Priority Data

Sep. 23, 1998 [EP] European Pat. Off. ..... 98440213

[51] Int. Cl.[7] ..... E05C 1/06

[52] U.S. Cl. ..... 292/39; 292/36; 292/167; 292/172; 292/DIG. 26

[58] Field of Search ..... 292/137, 36, 39, 292/172, 167, 139, 142, DIG. 24, DIG. 26; 70/109, DIG. 6

[56] References Cited

U.S. PATENT DOCUMENTS

| | | | |
|---|---|---|---|
| 4,548,432 | 10/1985 | Bengtsson | 292/8 |
| 4,958,866 | 9/1990 | Larsson | 292/245 |
| 4,962,653 | 10/1990 | Kaup | 70/107 |
| 5,096,237 | 3/1992 | Hotzl | 292/34 |
| 5,495,731 | 3/1996 | Riznik | 70/108 |
| 5,782,114 | 7/1998 | Zeus et al. | 70/109 |
| 5,896,764 | 4/1999 | Monsch et al. | 70/107 |

FOREIGN PATENT DOCUMENTS

| | | | |
|---|---|---|---|
| 60208 | 9/1982 | European Pat. Off. . | |
| 378758 | 7/1990 | European Pat. Off. | 292/142 |
| 385360 | 9/1990 | European Pat. Off. | 292/139 |
| 454960 | 11/1991 | European Pat. Off. | 292/39 |
| 576787 | 1/1994 | European Pat. Off. | 292/142 |
| 2122244 | 1/1984 | United Kingdom | 70/109 |

*Primary Examiner*—B. Dayoan
*Assistant Examiner*—Clifford B Vaterlaus
*Attorney, Agent, or Firm*—Harrison & Egbert

[57] ABSTRACT

An espagnolette or espagnolette-lock for a door or the like, having a control mechanism including, on the one hand, a springy mechanism for automatically restoring a operating rod into locking position and, on the other hand, a locking device capable of maintaining this operating rod in its unlocked position upon opening of the leaf.

The locking device consists of a lever fitted in the casing, about a spindle perpendicular to the plane of the latter, so as to be capable of tilting between an inactive position and an active position in which it co-operates with a stop directly or indirectly made integral with the operating rod, in order to impede the latter from moving under the action of the springy means, the lever being extended, beyond its axis of pivoting, by a control pawl on which are capable of acting an unlocking mechanism in the shape of an actuator directly or indirectly integral with a spring-bolt.

11 Claims, 2 Drawing Sheets

ESPAGNOLETTE OR ESPAGNOLETTE-LOCK FOR A DOOR, FRENCH WINDOW OR THE LIKE

BACKGROUND OF THE INVENTION (1) Field of the Invention

The invention relates to an espagnolette or espagnolette-lock for a door, French window or the like, comprising, accommodated in a central casing, a control mechanism designed so as to be capable of actuating at least one operating rod and including, on the one hand, springy means for automatically restoring the operating rod into locking position, as well as manual control means, in particular a tumbler actuated through a control handle, for ensuring the unlocking of this operating rod and resetting the springy means and, on the other hand, a locking device capable of maintaining the operating rod in its unlocked position upon opening of the leaf of the door, French window or the like, and unlocking means capable of releasing the locking device when closing the leaf against the sash-frame, in order to allow the restoring of the operating rod into locking position, this espagnolette or espagnolette-lock including also a spring-bolt automatically restored into protruding position through a spring.

This invention will find its application in the field of the building ironmongery and in particular relates to the so-called automatic locking fittings.

(2) Description of the Prior Art

One should indeed note that there are already known espagnolettes or espagnolettes-locks meeting the above description. They are aimed at facilitating the locking of the door, French window or the like in that the operating rod or rods are automatically pushed back into their locking position under the action of springy restoring means the action of which is, as a matter of fact, released at the very moment at which the leaf is closed against the sash-frame. On the other hand, when unlocking and opening this leaf, the action performed by the user on a control handle results into bringing this or these operating rods into their unlocked position and in ensuring the resetting of the aforementioned springy means, while an adequate locking device simultaneously maintains the operating rod or rods in this unlocked position against the action of the spring which substantially forms the springy restoring means.

Finally, such an espagnolette-lock also includes unlocking means which are capable of releasing the locking device when closing the leaf against the sash-frame, in order to allow the restoring of this or these operating rods into locking position.

An espagnolette or espagnolette-lock meeting this description has been described, in particular, in FR-2.500.874. In this case, the locking device consists of a locking pawl which is tiltingly fitted at the level of a face-plate which usually covers the various organs of the espagnolette-lock at the level of the front edge of the leaf. As a matter of fact, this locking pawl acts in the direction of moving of this leaf, so that, when opening the latter, it automatically tilts towards the sash-frame, this under the action of a spring, whereas, when closing this leaf, the sash-frame is capable of pushing back this locking pawl against said spring.

One should note that such a locking pawl is extended, at the level of its portion inside the casing containing the control mechanism, by a lever through which it is, as a matter of fact, capable of maintaining the operating rod or rods in their unlocked position, this at the moment at which the leaf is opened and, hence, as soon as this locking pawl could be released from the sash-frame.

As a matter of fact, such a solution has the drawback that the release mechanism, which is in the shape of an external and distinct organ of the espagnolette or espagnolette-lock, is dissociated from a locking organ of this espagnolette or espagnolette-lock. This often results into non-synchronous actions between the moment at which the locking organs are effectively located in front of their respective keeper on the sash-frame. Therefore, it often happens that either of these locking organs strikes against the sash-frame, e.g. their keeper, without engaging into it.

Now, this risk is the larger as the fillister backlash between the leaf and the sash-frame is varied from one door or French window to another. Anyway, it often changes in the course of time, e.g. because of a distortion of the leaf against its sash-frame.

These fillister-backlash problems have already caused the manufacturers to design hinging fittings for these doors, French windows or the like provided with three-dimensional adjusting means, in order to be able to adjust the positioning of this leaf with respect to its sash-frame.

Likewise, such adjusting means are often located at the level of the locking fittings, in order to ensure a good co-operation between the locking organs and their keeper.

Accordingly, in order to cope with the above-mentioned problem, one could also have thought of providing the espagnolette or espagnolette-lock as described in FR-2.500.874 with adjusting means aimed at allowing an operator to adjust, with respect to this fillister backlash, the positioning of the locking pawl which is tiltingly fitted at the level of the face-plate, so that the release with a view to locking the springy restoring means aimed at pushing back the operating rods into their locked position occurs at the proper moment.

Now, such a solution would only have made even more difficult the task of the operators who ensure the fitting of this kind of espagnolettes or espagnolettes-locks and especially of those who have to install a door that is provided with it because of the numerous adjustings to be carried out. In addition, this solution was not capable of coping with the risk of a change in the fillister backlash in the course of time. As a matter of fact, sooner or later, it would have obliged these operators or the user to proceed to new adjustments which would prove very difficult to be carried out.

SUMMARY OF THE INVENTION

Finally, this invention is able to cope with the above-mentioned problems by associating to one of the locking organs of the espagnolette or espagnolette-lock, in particular to the spring-bolt, this function of the unlocking device. Accordingly, the latter can act to control the automatic locking of the operating rod or rods only when the locking organ has entered into co-operation with its keeper arranged on the sash-frame. This leads to a necessarily synchronous action.

To this end, the invention relates to an espagnolette or espagnolette-lock for a door, French window or the like, comprising, accommodated in a central casing, a control mechanism designed so as to be capable of actuating at least one operating rod and including, on the one hand, springy means for automatically restoring the operating rod into locking position, as well as manual control means for ensuring the unlocking of this operating rod and the resetting of the springy means and, on the other hand, a locking device capable of maintaining the operating rod in its unlocked position upon opening of the leaf of the door, French window or the like and unlocking means capable of releasing the locking device when closing the leaf against its sash-frame, in order to allow the restoring of the operating rod into locking position. This espagnolette or espagnolette-lock also includes a locking organ, in particular a spring-bolt automatically restored into protruding position through a spring, characterized in that the locking device has a lever fitted in the casing, about a spindle perpendicular to the plane of the latter, so as to be capable of tilting between an inactive position and an active position in which it is automatically pushed back under the action of springy restoring means when the operating rod is brought into its unlocking position, in order to co-operate with a stop directly or indirectly made integral with the operating rod, in order to impede the latter from moving under the action of the springy means. This lever being extended, beyond its axis of pivotment, by a control pawl on which are capable of acting the unlocking means in the shape of an actuator directly or indirectly integral with the spring-bolt and so designed as to be capable of pushing the lever back from its active position into its inactive position during the springy restoring of this spring-bolt into protruding positions. The unlocking means being also completed with a retaining organ, on the one hand, capable of retaining the spring-bolt in its unlocking or partially locked position when the leaf is open and, on the other hand, so designed as to be controlled and thus made inactive in order to release the spring-bolt from the sash-frame, in particular from the keeper the latter is provided with and which is aimed at receiving this spring-bolt.

This invention will be better understood when reading this following description which relates to an embodiment which is given only as an indication and a non-exhaustive example.

This description will be better understood when referring to the attached drawings.

BRIEF DESCRIPTION OF THE DRAWINGS

FIG. 3 is a plan view of the lever defining the locking device, whereas

DESCRIPTION OF THE PREFERRED EMBODIMENTS

Figure 1:
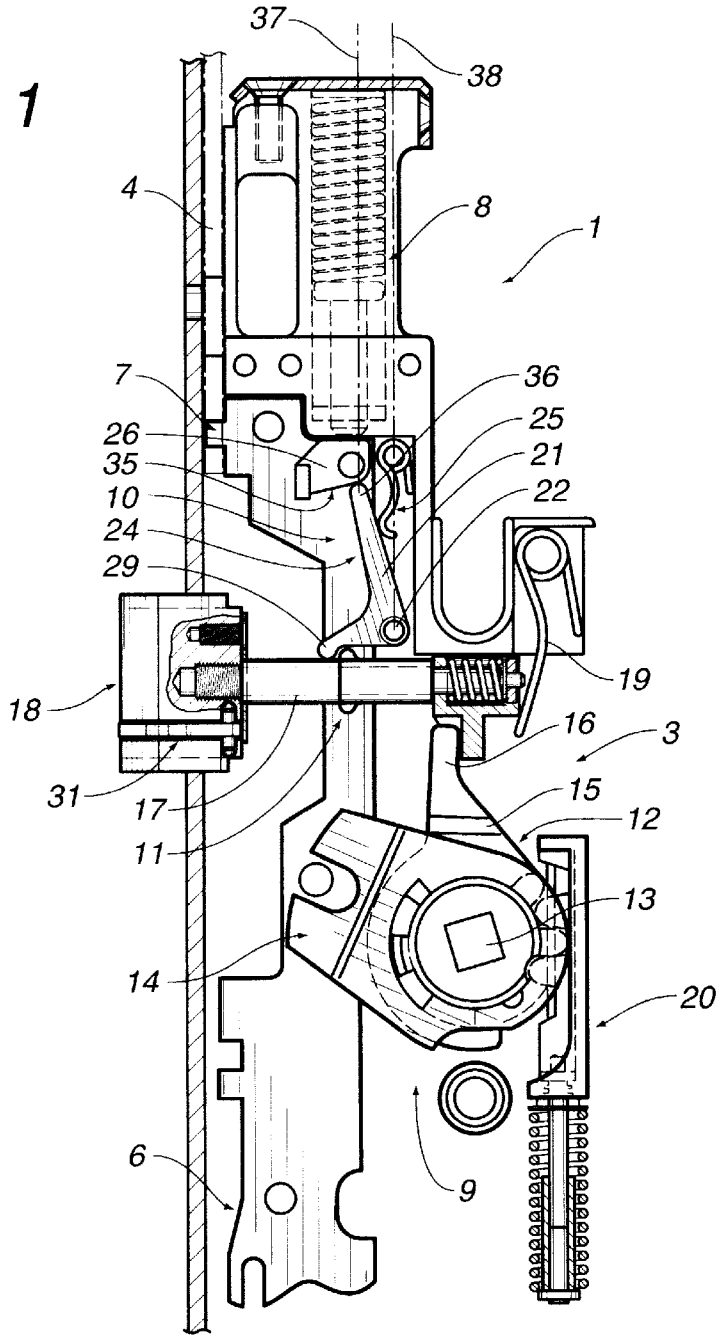
FIG. 1 is a schematic partial view of the control mechanism of the espagnolette or espagnolette-lock object of this invention, the elements having been shown in a configuration in which the operating rod or rods are maintained in unlocked position against the action of springy means.
Figure 5:
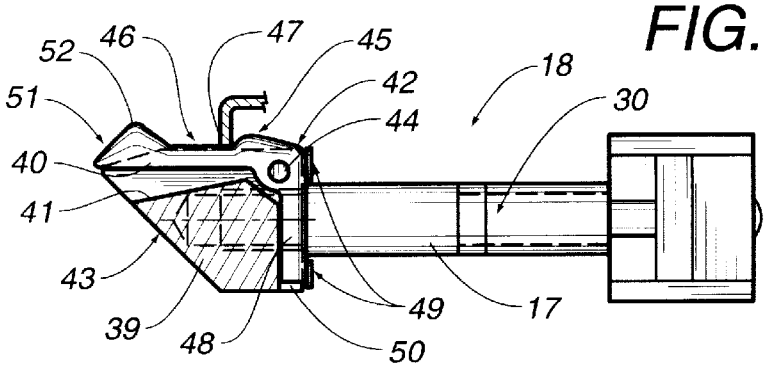
FIG. 5 is a schematic plan and partly cross-sectional view of the spring-bolt receiving, on the one hand, the actuator and, on the other hand, the retaining organ capable of maintaining it in unlocked or partially locked position.
Figure 2:
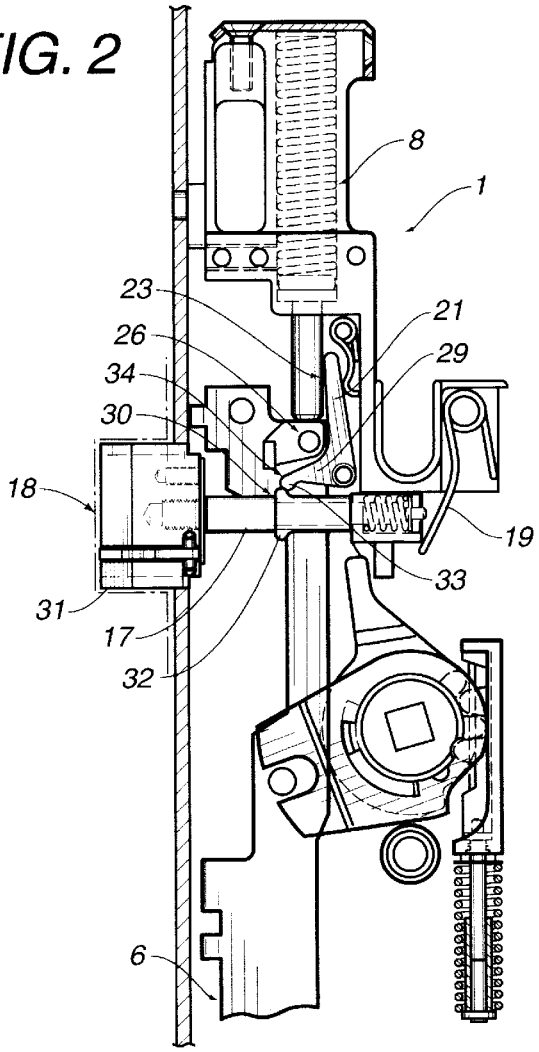
FIG. 2 is a view similar to FIG. 1, the elements being shown here in their position corresponding to the locking of the operating rod or rods.

As shown in FIGS. 1 and 2 of the attached drawings, this invention relates to an espagnolette or espagnolette-lock 1 for a door, French window or the like, comprising, accommodated in a central casing 2, a control mechanism 3 designed so as to be capable of actuating at least one operating rod 4.

In this respect, one should note that an espagnolette or espagnolette-lock 1 may be provided with such an operating rod 4 extending above and/or below the central casing 2, as well as it may be provided with two operating rods 4 extending, respectively, above and/or below the central casing 2 and which, through the control mechanism 3, may be caused to move in one and the same direction or in opposite directions. In the latter case, this control mechanism 3 of the espagnolette-lock 1 acts on one of the operating rods 4 through a motion reverser, known to one with ordinary skill in the art.

In addition, this control mechanism 3 can act on the operating rod or rods 4, either directly or by means of a support 6 accommodated in the casing 2 and connected at its ends, through adequate connecting means 7, to this or these operating rods 4.

This invention more specifically relates to the espagnolettes or espagnolettes-locks the control mechanism 3 of which includes, on the one hand, springy means 8 for automatically restoring these operating rods 4 into locking position and, on the other hand, manual control means 9 for allowing the user to manually ensure their unlocking and the resetting of the springy means 8.

In this respect, this espagnolette-lock 1 also includes a locking device 10 capable of maintaining the operating rods 4 in their unlocked position upon opening of the leaf corresponding to the door, French window or the like, as well as unlocking means 11 capable of making this locking device 10 inactive when closing the leaf against its sash-frame and of thus allowing the restoring of the operating rods 4 into locking position.

According to a non-exhaustive example of embodiment of this invention, the manual control means 9 are formed by a tumbler 12 including a recess 13 for receiving an operating square of a control handle, this tumbler 12 acting on the operating rods 4, through the support 6, by means of a driving organ 14 of an adequate configuration. On this tumbler 12 may advantageously also be fitted a crown 15 provided with an actuating pawl 16 capable of acting on the stem 17 of a spring-bolt 18 which is pushed back into its protruding position under the action of a restoring spring 19.

In this respect, springy restoring means 20 can also act on the tumbler to systematically restore the latter and, hence, the control handle, into a resting position upon a locking or unlocking action.

Usually, an espagnolette-lock also receives a key member (not shown in the figures) capable of acting on a dead bolt.

Figure 3:
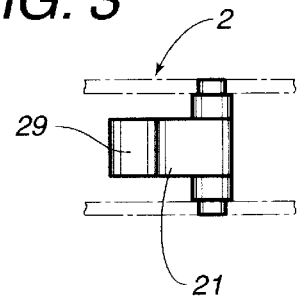

According to the invention, the locking device 10 which allows to maintain the operating rods 4 in their unlocked position against the action of the springy means 8, upon opening of the leaf having a lever 21 (which can be seen in FIGS. 1, 2 or also in FIG. 3) mounted in the casing 2, about a spindle 22 perpendicular to the plane of the latter, so as to be capable of tilting between an inactive position 23, as can be seen in FIG. 2, and a second, active position 24, shown in particular in FIG. 1 and in which it is automatically pushed back under the action of springy restoring means 25 provided for this purpose in the casing 2.

This lever 21 is brought into this active position 24 after the operating rod or rods 4 have been pushed back into their unlocking position, e.g. through manual control means 9. Under such circumstances, this lever co-operates with a stop 26 made integral, directly or through the support 6, as shown in the figures, with at least one of the operating rods 4, this in order to allow this lever 21 to impede the movement of the latter under the action of the springy means 8.

Figure 4:
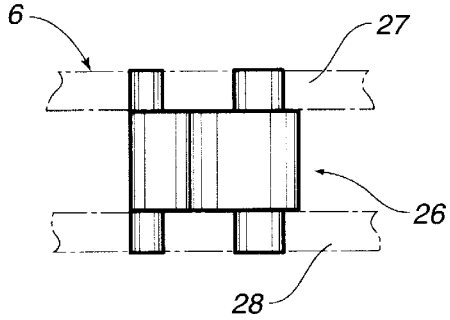
FIG. 4 is a similar view of the stop.
Figure 6:
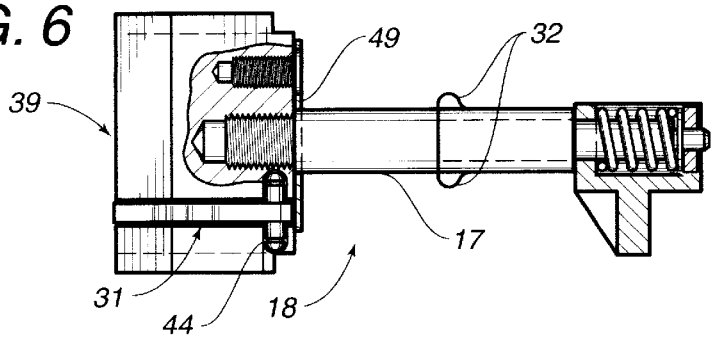
FIG. 6 is a schematic elevational and partly cross-sectional view of this spring-bolt.

Within the framework of the embodiment shown in the drawings and as shown in particular in FIG. 4, the stop 26 is inserted, as a spacer, between the two strictly identical wings 27, 28 defining, in this area of the casing 2, a split support 6. This allows the latter, without creating additional occupied space, to pass around other parts of the control mechanism 3, in this case the stem 17 of the spring-bolt 18. Thus, this stop 26 is made integral, e.g. through riveting, with the wings 27, 28.

Finally, according to the invention, the lever 21 is also extended, beyond its pivot axis 22, by a control pawl 29 on which are capable of acting the unlocking means 11 in the shape of an actuator 30 directly or indirectly integral with the spring-bolt 18 and so designed as to be capable of pushing the lever 21 back from its active position 24 into its inactive position 23 during the springy restoring of the spring-bolt 18 into its protruding position. One should note that the unlocking means 11 are also completed with a retaining organ 31, on the one hand, capable of retaining the spring-bolt 18 in a unlocking or partially locked position, as can be seen in FIG. 1, when the leaf is open and, on the other hand, so designed as to be controlled and thus made inactive in order to release the spring-bolt 18 from the sash-frame, in particular from the keeper the latter is provided with and which is aimed at receiving this spring-bolt 18.

To summarize, the way of operating of this espagnolette is as follows:

- by acting on the tumbler 12 through the control handle and starting from the locking position, the user brings the operating rod or rods 4 into their unlocking position against the action of springy means 8;
- the lever 21 constantly pushed back towards the stop 26 under the action of its springy restoring means 25 tilts into its active position 24 when the stop 26 passes beyond it. One should note that this angle of pivoting of the lever 21 towards its active position 24 can be limited through any stop placed in the casing or also, as shown in FIG. 1, directly by the stem 17 of the spring-bolt 18 on which then rests its control pawl 29;
- the control to unlock the espagnolette necessarily leads to the drawing back of the spring-bolt 18 under the action of its restoring spring 19, which results into making the retaining organ 31 active, i.e. capable of retaining this spring-bolt 18 in an unlocked or partially locked position, this when the leaf of the door, French window or the like is open;
- on the other hand, when closing this leaf against its sash-frame, which results into bringing the spring-bolt 18 in front of its keeper, the retaining organ 31 pushed back by the latter releases the spring-bolt 18 which then returns into its locking position under the action of its spring 19;
- at the same time, the actuator 30 fitted on the stem 17 of the spring-bolt 18 enters into operation and, by acting on the control pawl 29 of the lever 21, brings the latter from its active position 24 into its inactive position 23;
- since nothing then impedes the operating rod or rods 4 from moving, they return into their locking position under the action of the springy means 8.

One should note that being able to maintain the spring-bolt in a partially locked, i.e. partially protruding, position when the leaf is open allows to impart, through the control mechanism 3, a longer travel distance to this spring-bolt, so that, in fully emerging position of the casing, it is capable of inserting farther into the corresponding keeper on the sash-frame and also of acting as a dead bolt. Since this spring-bolt is capable of being mechanically maintained in an intermediate position when closing the leaf, the keeper on the sash-frame is indeed not obliged to push this spring-bolt back over its full travel distance into the casing, which would otherwise be a problem.

As can be seen in the figures, the actuator 30 is advantageously in the shape of a rim 32 provided for at the level of the stem 17 of the spring-bolt 18, which rim 32 cooperates with a boss 33 with smoothed contours the control pawl 29 includes at its end 34 aimed at resting against this stem 17 of the spring-bolt 18.

This smoothed shape of the boss 33 and the rounded contour of the rim 32 are aimed at facilitating their respective smooth crossing both during the manual unlocking action and the automatic locking of the espagnolette.

In the same way, the bearing plane 35 defined by the stop 26 does not extend strictly perpendicularly to the direction of travel of the operating rod or rods 4, but is preferably inclined according to an ascending slope from the active position 24 towards the inactive position 23 of the lever 21, thus allowing the latter to be released without difficulty from this stop 26 under the mere action that is imparted to it by the spring-bolt 18 which is, furthermore, pushed back by the spring 19. Likewise, the free end 36 of the lever 21 has no sharp edges capable of clinging alongside this bearing plane 35.

Finally, one should note that under the action exerted by the springy means 8 onto the operating rod or rods 4, in particular onto the support 6, the stop 26 imparts to the lever 21, in this active position 24, a torque tending to cause it to pivot about its axis 22 farther in the direction of this active position 24, which results into causing the control pawl 29 to rest against the stem 17 of the spring-bolt 18. However, this torque, which results from the offset of the vertical axes 38, 37 respectively passing through the axis of pivoting 22 of the lever 21 and the bearing point between the end 36 of the latter and the stop 26, is defined, on the one hand, so as to be sufficient to ensure the holding in unlocked position of the operating rod or rods 4 against the action of the springy means 8 and, on the other hand, so as to be as low as possible, in order to facilitate the task of the actuator 30 when it must push this lever 21 back into its inactive position 23. One should note that the length of the control pawl 29 as well as the height of the rim 32 are defined so as to allow the latter to impart to the lever 21 a sufficient angle of rotation to allow it to retract in front of the stop 26, with a view to the locking of the espagnolette or espagnolette-lock.

According to a preferred embodiment, the rim 32 corresponding to the actuator 30 is defined, as can be seen in FIGS. 1, 2, 5 and 6, at the level of a sleeve which is inserted onto the stem 17 of the spring-bolt 18. Such a sleeve has advantageously a symmetrical shape with respect to its horizontal median plane, which configuration solves the problem of reversibility of the spring-bolt 18, but also the needs for a failureless fitting of the espagnolette or espagnolette-lock.

In addition, on both sides of this sleeve are defined flat faces which favor the guiding of the stem of the spring-bolt 18 between the wings 27, 28 of the support 6, while contributing, among others, to immobilizing this sleeve in rotation.

As regards the retaining organ 31 designed so as to be capable of retaining the spring-bolt 18 in an unlocked or partially locked position when the leaf is open, while being capable of being controlled and, thus, made inactive in order to release the spring-bolt 18 from the sash-frame, preferably from the keeper aimed at receiving the spring-bolt 18, it is directly integrated into the head 39 of this spring-bolt 18 and it is in the shape of a lever 40 accommodated in a groove 41 provided for at the level of the back face 42, opposite the beveled one 43, of this head 39 of the spring-bolt 18. This groove 41 and, therefore, said lever 40 extend parallelly to the latter's movement. As a matter of fact, this lever 40 is pivotingly fitted in this groove 41, about a vertical axis 44 perpendicular to the travel of the spring-bolt 18.

In addition, at the level of the outer edge 45 of this lever 40 is provided for a cut-out 46 capable of co-operating, in the active position of this retaining organ 31, with a retaining rim 47 provided for this purpose at the level of the casing 2.

Finally, the lever 40 is extended, beyond its axis of pivoting 44, by a bend 48 on which acts a restoring spring 49 designed so as to be capable of automatically pushing this retaining organ 31 back into an active position. This restoring spring 49 is preferably defined by a springy blade fixed to the rear of the head 39 of the spring-bolt 18.

One notes that this bend 38 of the lever 40, beyond its axis of pivotment 44, is also accommodated in a groove 50 which in this case extends at the rear of the head 39 of the spring-bolt 18.

The bottom of this groove 50 acts as a stop against which the bend 48 is applied under the action of the blade spring 49, corresponding to the active position of the retaining organ 31.

In addition, in order to allow the latter to retract during the drawing back of the spring-bolt 18, the outer edge 45 of the lever 40, in front of the retaining rim 47, has a shape defined without a setback, in order to allow this action.

Finally, the lever 40 is also so designed as to be capable of co-operating with the sash-frame, in particular with the keeper aimed at receiving the spring-bolt 18, when closing the leaf, in order to release the spring-bolt 18. Thus, this lever 40 includes, alongside its portion 51 which in all cases remains protruding with respect to the front edge of the casing 2, a control pawl 52 in the shape of a boss at the level of its outer edge 45. This control pawl 52 is protruding with respect to the back face 42 of the head 39 of the spring-bolt 18 and is therefore oriented towards the sash-frame of the door.

Thus, when closing the leaf against the sash-frame, the action of the keeper on the beveled face 43 of the spring-bolt 18 first of all causes the latter to move back. Then, when this spring-bolt 18 is capable of penetrating into this keeper, the latter automatically actuates the control pawl 52 of the lever 40, so as to cause the retaining organ 31 to be inactive, which allows this spring-bolt 18 to reach its fully locked position. At the same time, the actuator 30, integral with the stem 17 of this spring-bolt 18, acts on the control pawl 29, which results into the tilting of the lever 21 into its inactive position 23. By thus retracting in front of the stop 26, this lever 21 releases the support 6 and thus the operating rods 4 which are then capable of being automatically restored into locking position under the action of the springy means 8.

What is claimed is:

1. An espagnolette-type lock apparatus for a leaf received within a sash-frame, the apparatus comprising:

an operating rod;

a casing;

a control means received within said casing, said control means for actuating said operating rod, said control means comprising a spring member connected to said operating rod for automatically moving said operating rod to a locking position, said control means further comprising a manual controller connected to said operating rod for unlocking said operating rod and for resetting said spring member;

a locking means for maintaining said operating rod in an unlocking position upon an opening of the leaf from the sash-frame;

unlocking means for releasing said locking means when the leaf is closed into the sash-frame, said unlocking means for restoring said operating rod to the locking position; and a spring-bolt urged toward a locked position by a spring, said locking means comprising a lever affixed within said casing, said lever being affixed to a spindle extending perpendicular to a plane of said lever, said lever pivotable about said spindle between an inactive position and an active position, said lever being urged by a restoring spring to said active position when said operating rod is moved to the unlocking position, said lever being cooperative with a stop affixed to said operating rod so as to impede said operating rod from moving to the locking position, said lever having a control pawl extending beyond said spindle, said control pawl being cooperative with an actuator on said spring-bolt so as to push said lever from the active position toward the inactive position during a movement of said spring-bolt to the locked position, said unlocking means comprising a retaining organ means for retaining said spring-bolt in an unlocked or partially locked position when the leaf is open from the sash-frame, said retaining organ means for releasing said spring-bolt from the unlocked or partially locked position when the leaf is closed into the sash-frame.

2. The apparatus of claim 1, said casing having a support positioned therein, said support having split shape defined by two identical wings with a spacer formed therebetween, said spacer being affixed to said wings, said control means for actuating said operating rod through said support.

3. The apparatus of claim 1, said spring-bolt having a stem extending within said casing, said actuator having a rim formed so as to extend radially outwardly of said stem, said control pawl resting against said stem in the active position of said lever, said restoring spring urging said control pawl against said stem.

4. The apparatus of claim 1, said stop having a bearing plane cooperative with an end of said lever.

5. The apparatus of claim 4, the pivot axis of said lever about said spindle and a bearing point between said end of said lever and said stop when said lever is in said active position being on vertical axes parallel to said operating rod, said stop imparting a torque to said lever to pivot said lever from the inactive position toward the active position.

6. The apparatus of claim 3, said rim formed at an end of a sleeve extending over said stem of said spring-bolt, said sleeve having a symmetrical shape across a horizontal median plane, said sleeve having flat faces positioned so as to guide said stem of said spring-bolt between two wings.

7. The apparatus of claim 1, said spring-bolt having a head receiving said retaining organ means, said retaining organ means comprising a lever pivotally received in a groove formed at a back face of said head, said back face being opposite a beveled face of said head, said groove extending in parallel relation to a direction of movement of said spring-bolt, said lever of said retaining organ means pivotable about an axis perpendicular to the direction of movement of said spring-bolt, said lever of said retaining organ means having a cut-out at an outer edge thereof, said cut-out cooperative with a retaining rim formed in said casing.

8. The apparatus of claim 7, said retaining organ means further comprising a restoring spring for urging said lever of said retaining organ means to an active position.

9. The apparatus of claim 8, said lever of said retaining organ means having bend portion extending beyond a pivot axis of said lever of said retaining organ means, said restoring spring of said retaining organ means being a blade spring affixed to a rear of said head of said spring-bolt, said blade spring acting on said bend portion.

10. The apparatus of claim 9, said bend portion being received in a groove formed at said rear of said head of said spring-bolt, said groove formed at said rear of said head of said spring-bolt having a bottom abutting said bend portion when said restoring spring of said retaining organ means urges said lever of said retaining organ means to the active position.

11. The apparatus of claim 7, said lever of said retaining organ means having a protruding portion extending outwardly of said casing, said protruding portion having a boss protruding with respect to said back face of said head, the apparatus further comprising:

a keeper connectable to the sash-frame, said bases cooperative with said keeper when the leaf is closed within the sash-frame.

* * * * *